United States Patent [19]

Cox

[11] Patent Number: 4,708,789

[45] Date of Patent: Nov. 24, 1987

[54] MOBILE MINERAL PREPARATION PLANT

[75] Inventor: Bernie F. Cox, Mansfield, Ohio

[73] Assignee: Mineral Preparation, Inc., Mansfield, Ohio

[21] Appl. No.: 879,445

[22] Filed: Jun. 27, 1986

[51] Int. Cl.[4] ..... B03B 5/14

[52] U.S. Cl. ..... 209/457; 209/462; 209/504

[58] Field of Search ..... 209/13, 17, 18, 155, 209/156, 172.5, 173, 461, 462, 455, 457, 491, 493, 504

[56] References Cited

U.S. PATENT DOCUMENTS

| | | | |
|---|---|---|---|
| 804,841 | 11/1905 | Hedburg | 209/455 |
| 1,027,143 | 5/1912 | Myrtin | 209/455 |
| 1,091,797 | 3/1914 | Boone | 209/457 |
| 1,926,408 | 12/1933 | Sayers | 209/457 |
| 2,122,039 | 6/1938 | Logue | 209/457 |
| 2,612,997 | 10/1952 | Harvengt | 209/457 |
| 2,638,214 | 5/1953 | Harvengt | 209/457 |
| 2,979,203 | 4/1961 | Moore | 209/455 |
| 4,028,231 | 6/1977 | Parham | 209/457 |

FOREIGN PATENT DOCUMENTS

| | | | |
|---|---|---|---|
| 696172 | 8/1953 | United Kingdom | 209/455 |

OTHER PUBLICATIONS

"Coal Washers" sales brochure of Ore Reclamation Company, received Sep. 16, 1985 (Exhibit A).

"Coal Washers" sales brochure of Ore Reclamation Company, received Sep. 16, 1985 (Exhibit C).

*Primary Examiner*—David A. Scherbel

*Assistant Examiner*—Donald T. Hajec

*Attorney, Agent, or Firm*—Pearne, Gordon, McCoy & Granger

[57] ABSTRACT

An apparatus for separating granular material such as crushed coal or ore that includes particles of different specific gravity. The apparatus includes an elongated frame defining a receiving chute and a discharge chute. A plurality of hydraulic cells are supported in tanden on the frame, each cell including a wave chamber, a screen forming a material supporting floor submerged in the wave chamber, plungers for cyclically raising and lowering the water level in the wave chamber and a refuse bin adapted to receive heavier particles that are separated out in the wave chamber and that collect above the screen. The wave chambers define a flow channel extending from the receiving chute to the discharge chute and adapted to contain a suspension or slurry of the crushed particles. The plungers for each cell operate in a cooperative manner to generate a wave which progresses from the upstream end to the downstream end, the plungers having a decreasing stroke so that some reinforcement of the wave is provided but the amplitude diminishes gradually toward the downstream end of the flow channel. With this arrangement, the hydrodynamic separation proceeds from a relatively rough level to a relatively fine level at the downstream cell. Accordingly, the downstream cell has the capability of separating out even those particles relatively close in specific gravity to that of the desired particles.

10 Claims, 12 Drawing Figures

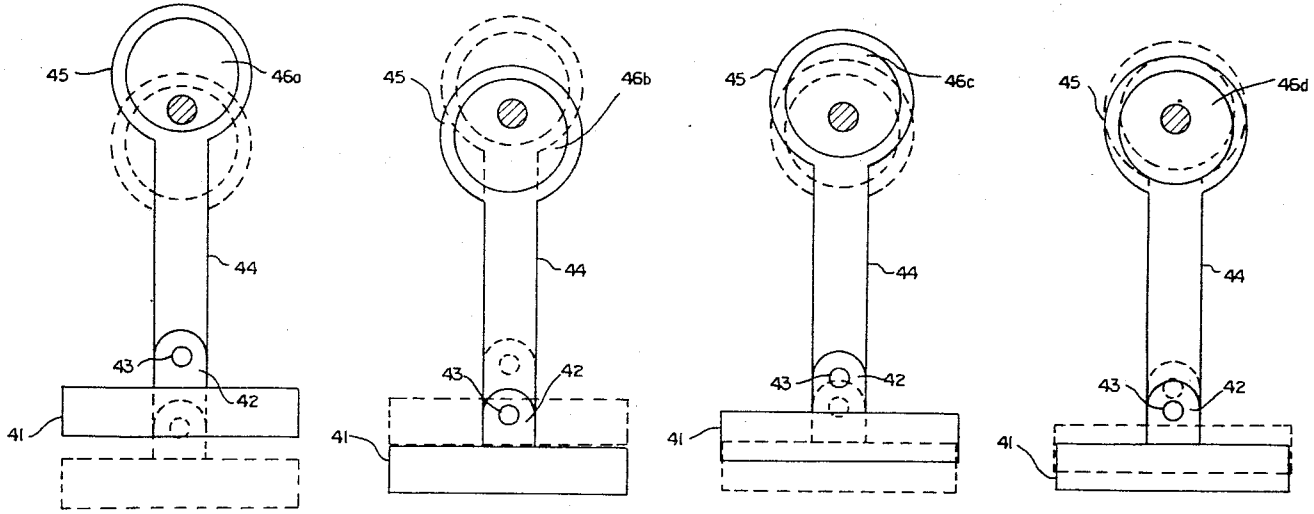
FIG. 8
FIG. 9
FIG. 10
FIG. 11
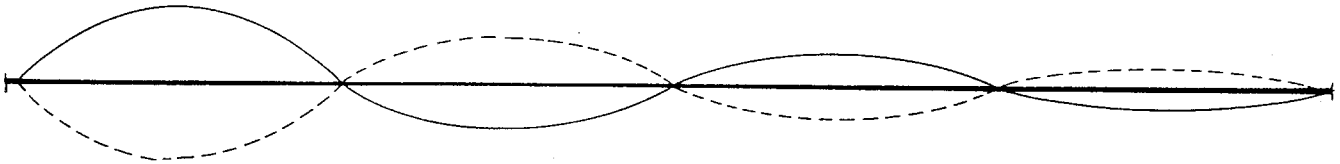
FIG. 12

MOBILE MINERAL PREPARATION PLANT

BACKGROUND OF THE INVENTION

This invention relates to the processing of minerals such as coal and various ores and especially to the separation of solid material of different densities from the mined material. More particularly the invention relates to a multiple cell jigging apparatus that utilizes a hydrodynamic process to clean or concentrate crushed coal or ore.

Jigging devices are frequently used in the mining industry Basicly, these devices utilize water agitation, flow or other hydrodynamic effect to classify and separate materials of different densities. Typical jigging devices of this type are shown in the following U.S. patents:

| U.S. Pat. No. | Inventor | Date |
|---|---|---|
| 1,689,536 | Silverston | 10/30/28 |
| 2,082,467 | Prins | 6/1/37 |
| 2,139,047 | Tromp | 12/6/38 |
| 3,204,764 | Prins | 9/7/65 |

These devices depend in their operation on the difference in specific gravity of coal particles or particles of other mined material and on that of the impurities. Bituminous coal for example has a specific gravity of 1.35 whereas most undersirable impurities have a specific gravity of about 1.55 or higher. Typical of the objectionable impurities that occur in coal are slate, pyrite, clay, rock, crystaline sulphur.

In general terms the crushed coal or ore is delivered to the jig or washer where it is submerged in water to form a slurry. Through various means, water currents are formed including both horizontal currents along the flow path and vertical currents that may be generated in any number of ways. The difference in specific gravity between the desirable material and the heavier impurities is magnified when the crushed material is submerged in water and thus the differential is relatively greater.

In view of the hydrodynamic action created, the lighter particles collect near the top of the flow path and the heavier material sinks to the bottom because it is less mobile and does not flow with the current. As a result the lighter material is discharged with the water flow after heavier material or refuse has sunk to a lower level. A subsequent dewatering process produces a "clean" or concentrated coal or ore.

One of the major problems associated with the utilization of many types of mined coal is the high sulphur content. Sulphur, having a specific gravity very close to that of coal is very difficult to separate out by prior art hydrodynamic processes and accordingly the cleaned coal still may contain an undesirable amount of crystaline sulphur. This material is highly objectionable when the coal is burned and has led to severe restrictions on the utilization of coal as an energy source in spite of its ready availability in many areas.

The method and apparatus of the present invention provide for an improved cleaning and concentration of coal and other ore and not only resolve the difficulties described above but afford other features and advantages heretofore not obtainable.

SUMMARY OF THE INVENTION

It is among the objects of the invention to improve the cleaning and concentration of coal and other ores through the use of hydrodynamic processing.

Another object of the invention is to provide a mobile jigging apparatus for cleaning and concentrating coal and which has the capability to be easily moved from site to site where mining operations are performed.

Still another object of the invention is to provide a jigging apparatus with the capability to achieve separation of certain impurities or refuse from the crushed coal or ore wherein the specific gravity of the particular impurity is relatively close to that of the coal or ore.

These and other objects and advantages are achieved with the unique apparatus of the invention which is adapted to separate granular material such as crushed coal or ore including particles of different specific gravity. The apparatus includes an elongated frame defining a material receiving chute and a material discharge chute. A plurality of hydraulic cells are supported in tandem on the frame so as to define a flow channel for a suspension of the material and water extending from the receiving chute to the discharge chute. The received material is carried in a water suspension serially through the cells from the receiving chute to the discharge chute by means of a horizontal water flow or current. Each of the cells includes a water receptacle or tank having a semicylindrical floor, sidewalls, endwalls, and a partition extending between the sidewalls but spaced from the floor to define a plunger chamber and a wave chamber. The plunger chamber has a plunger adapted for reciprocating movement therein so as to generate cyclical raising and lowering of the water level in the adjacent wave chamber of the cell. The wave chamber has a screen that defines the floor of the flow channel which continues from the wave chamber of one cell to the other wave chamber of another. Accordingly, the water passes intermittently through the perforations in the screen as the water level is raised and lowered cyclically.

Each cell includes a refuse bin and elevator assembly located downstream of the respective plunger chamber and wave chamber. Each of the assemblies has a gate so that heavier material that collects just above the screen and in the lower portion of the slurry may be dumped in a controlled manner into the bin where the elevator raises it upwardly and laterally to a discharge point well above the water level. The material is partially dewatered before it is dumped.

The plunger for the cells are operated by means of adjustable eccentrics mounted on a common shaft. The shaft is connected through the eccentric to the respective plunger and the amplitude of the plunger oscillation is determined by means of a mechanism associated with the eccentric. Accordingly, the eccentrics are adjusted so that the amplitude of the wave generated varies from a relatively high amplitude at the upstream cell to a relatively low amplitude at the downstream cell. With this arrangement the hydrodynamic separation proceeds from a relatively rough level to a relatively fine level at the downstream cell. Thus, the wave generated along the flow channel progresses from a relatively high amplitude to a very low amplitude at the discharge chute.

Because of the finely tuned nature of the wave action along the plurality of cells the downstream cell has the capability of separating out even those particles relatively close in specific gravity to that of the desired material. Accordingly, the resulting product has an improved concentration which is particularly advantageous in many applications.

BRIEF DESCRIPTION OF THE DRAWINGS

FIGS. 8 through 11 are elevational views illustrating the construction and range of movement of the plunger assemblies for each of the four cells included in the apparatus of the invention; and FIG. 12 is a diagram associated with FIGS. 8 through 11 and illustrating the progressively diminishing amplitude of the wave form as it progresses along the flow channel from the most upstream cell to the most downstream cell.

DETAILED DESCRIPTION OF THE PREFERRED EMBODIMENT

Figure 1:
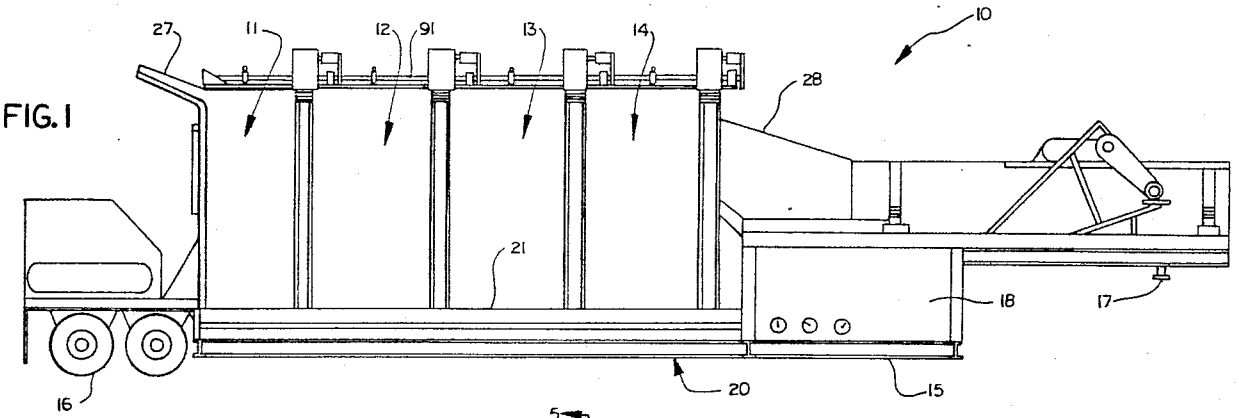
FIG. 1 is a side elevation of a mobile coal or ore concentration apparatus embodying the invention.
Figure 2:
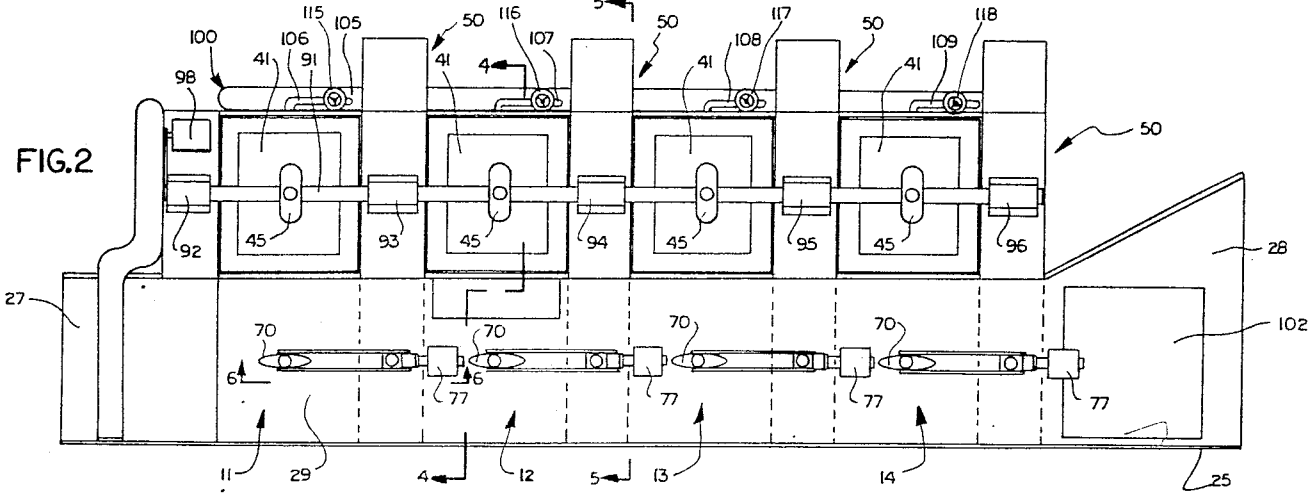
FIG. 2 is a plan view on an enlarged scale illustrating the main portion of the concentration apparatus of FIG. 1.
Figure 3:
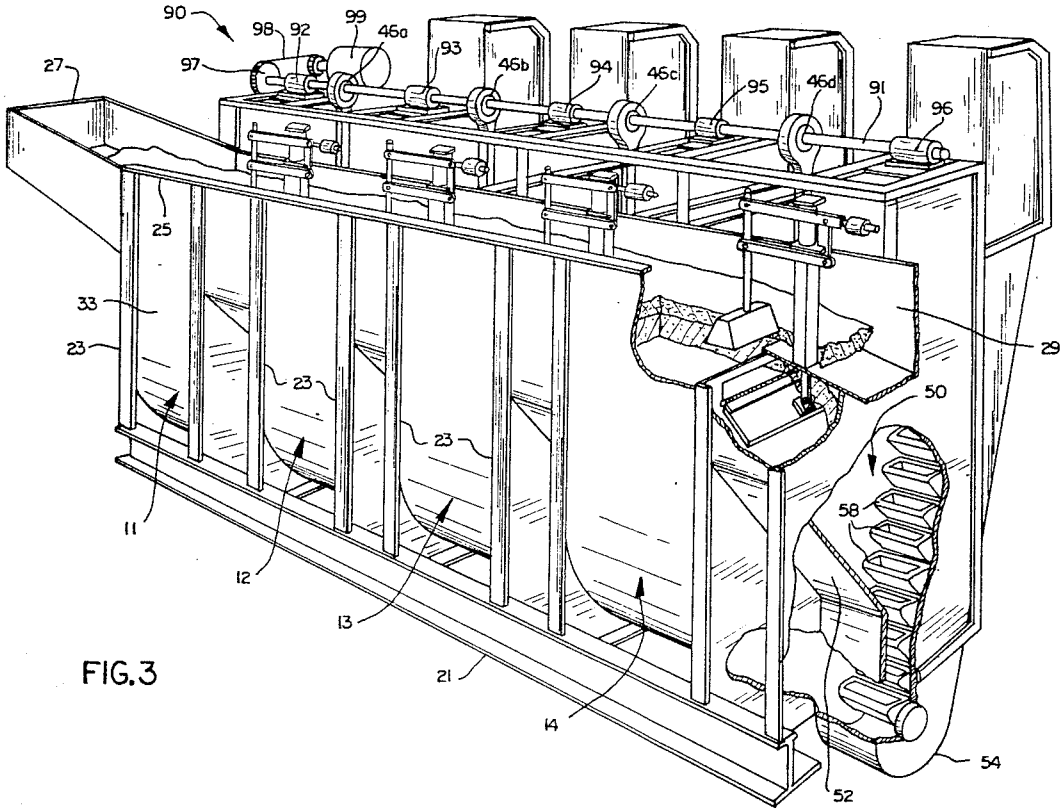
FIG. 3 is a fragmentary perspective view of the concentration apparatus of FIGS. 1 and 2 with parts broken away and shown in section for the purpose of illustration.

Referring more particularly to the drawings and initially to FIGS. 1, 2 and 3 there is shown a mobile mineral separation apparatus 10 of the type commonly referred to as a jigging apparatus wherein crushed material such as coal or ore is subject to a hydrodynamic process to separate out impurities of different densities from the desired mined material. The particular apparatus illustrated and described herein is designed for cleaning or concentrating of crushed coal, however the invention is applicable to the cleaning and processing various ores and other mined material.

The unit comprises four separate hydrodynamic cells 11, 12, 13 and 14 mounted on the chassis 15 of a trailer adapted to be towed by a truck or other transport means. When in operating condition, one end of the trailer is supported on a wheel carriage 16 while the other end is supported by a jack. For towing a hitch 17 is provided at one end for connection to a fifth wheel type vehicle. A water tank 18 is located at the forward end of the trailer.

General Arrangement

The jigging apparatus mounted on the chassis 15 includes a frame 20 having a pair of longitudinally extending I-beams 21 and 22, a plurality of vertical posts 23 and a pair of parallel longitudinally extending top rails 25 and 26. The frame supports a material receiving chute 27 located at the left end of the apparatus as viewed in FIGS. 1, 2 and 3 and a material discharge chute 28 located at the right hand end of the apparatus. Between the chutes 27 and 28, portions of the cells 11, 12, 13 and 14 define a wave channel or flow channel 29 along which a slurry of the crushed material is conveyed during the jigging process.

Cell Construction

Each of the cells 11, 12, 13 and 14 is of essentially the same construction and therefore the description of the cell construction and operation will be limited to that of the cell 11. Accordingly, the same numerals will be used to identify corresponding parts in the drawings in each of the cells 11, 12, 13 and 14.

Each of the cells is associated with a gate control assembly 60, a plunger drive 90 and a water supply system 100. There is one gate control assembly 60 for each cell however the same plunger drive 90 is used to drive the plungers of each of the four cells. Also the water supply system 100 is common for all four of the cells.

The cell 11 comprises two major components-namely a U-shaped water receptacle or tank 30 and a refuse elevator assembly 50. The elevator assembly is located downstream of the respective water tank 30. The water tank comprises parallel sidewalls 31 and 32, parallel end walls 33 and 34 and a semicylindrical floor 35. A partition wall 36 divides the upper portion of the tank into essentially equal size chambers including a plunger chamber 37 and a wave chamber 38. The bottom of the partition 36 is spaced considerably above the semicylindrical floor 35 so as to lend a generally U-shaped configuration to the tank as view transversely in FIG. 4.

A plunger assembly 40 is adapted to operate in the plunger chamber 37 and includes a rectangular plunger 41 that reciprocates in a vertical line and which is dimensioned to correspond to the dimensions of the plunger chamber 37 as viewed in a horizontal plane. The plunger 41 has a bracket 42 or clevis secured to its top that serves to connect the plunger 41 through a connector pin 43 to a plunger rod 44. The upper end 45 of the plunger rod is operatively connected to an eccentric 46 which provides a drive adapted to cause reciprocating movement of the plunger in the plunger chamber 37 and thus to generate a corresponding wave action in the mass of water located in the respective wave chamber 38.

A material support screen 47 is positioned horizontally in the wave chamber 38 to define with the adjacent surfaces of the partition 36 and the end wall 33, the respective portion of the wave channel 29 along which the slurry containing the crushed partices is carried.

The material support screen 47 comprises a perforate plate 48 supported on a rectangular grid-shaped frame 49. The plate 48 has holes of approximately $\frac{1}{4}''$ in diameter. The plate 48 for each cell has an area of about 13 square feet in a typical application.

Figure 4:
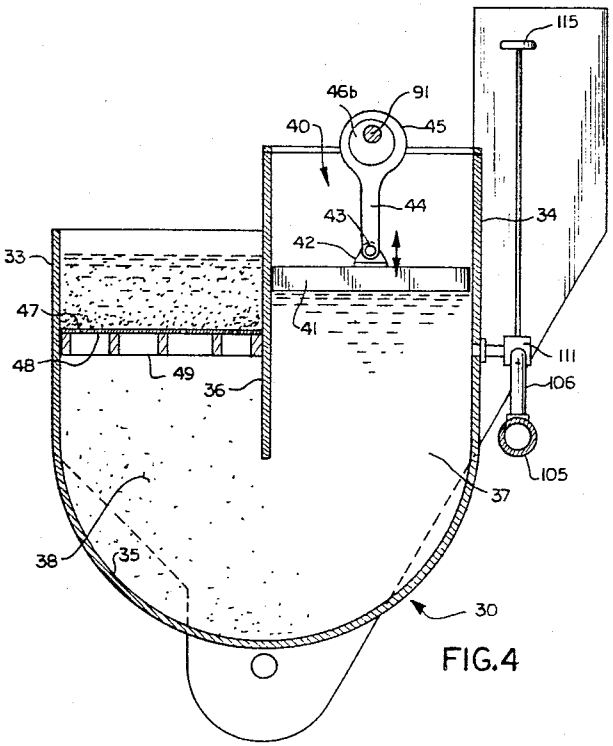
FIG. 4 is a transverse sectional .ivew taken on the line 4—4 of FIG. 2.
Figure 7:
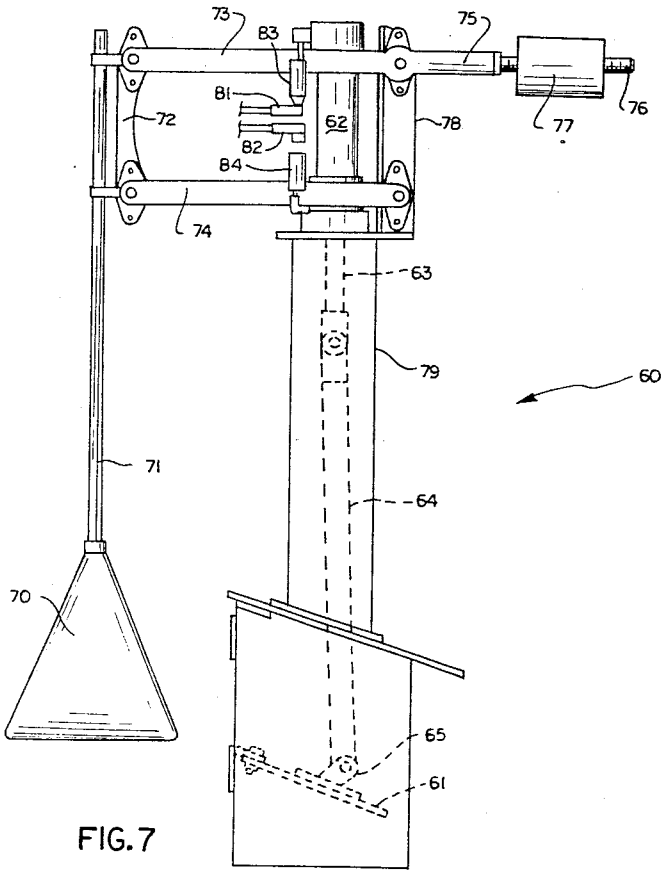
FIG. 7 is an elevational view on an enlarged scale illustrating the gate control system utilized in the apparatus of the invention.

As will be apparent from FIG. 4, the water tank 30 of each cell has a U-shaped configuration wherein the water level under normal circumstances would be the same in both the plunger chamber 37 and the wave chamber 38. However, when the plunger 41 is operated by means of the eccentric 46, a downward stroke of the plunger forces the water in the wave chamber 38 upwardly to a higher level above the screen 47 with the water passing through the perforated plate 48 during the stroke. The upward surge of water through the slurry is called the "pulsion" stroke and it achieves the jigging action that promotes the separation of the coal particles from the heavier particles which lack the mobility of the lighter material due to their greater density.

As indicated above, the stroke or amplitude of the plunger 41 is greatest in the cell 11 and decreases progressively from cell 11 through cell 14. In a typical arrangement the stroke of the plunger 41 of the cell 11 (as set using the eccentric 46) is 8 inches; the stroke for the cell 12, 4 ¾ inches; for the cell 13, 3 inches and for the cell 14, 2 inches. Thus, the heaviest material is separated out in the first cell and so on along the flow channel to the cell 14 where the very lightest refuse is separated from the coal particle. In other words, the refuse which has a specific gravity closest to that of the coal is separated out in the last cell.

As indicated above, each cell includes, in addition to a water tank 30, an elevator assembly 50 for conveying the refuse separated in a particular cell out of the unit through a dump chute at the side. The elevator assembly is located in a bin 51 defined by the sidewalls of adjacent water tanks 30 and by front and rear partition walls 52 and 53 as well as by a semicylindrical floor 54 located below the level of the floors 35 of the adjacent cells.

Figure 5:
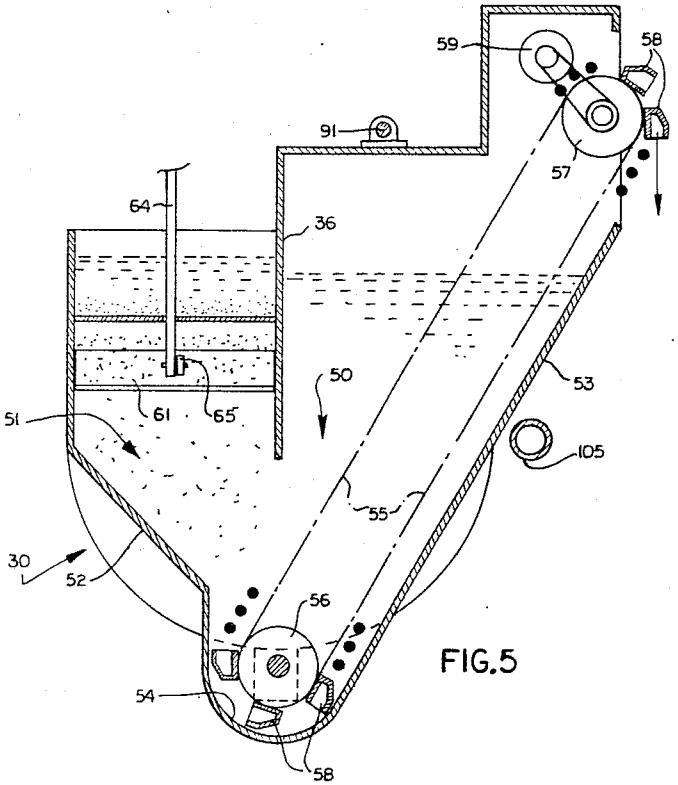
FIG. 5 is a transverse sectional view taken on the line 5—5 of FIG. 2.
Figure 6:
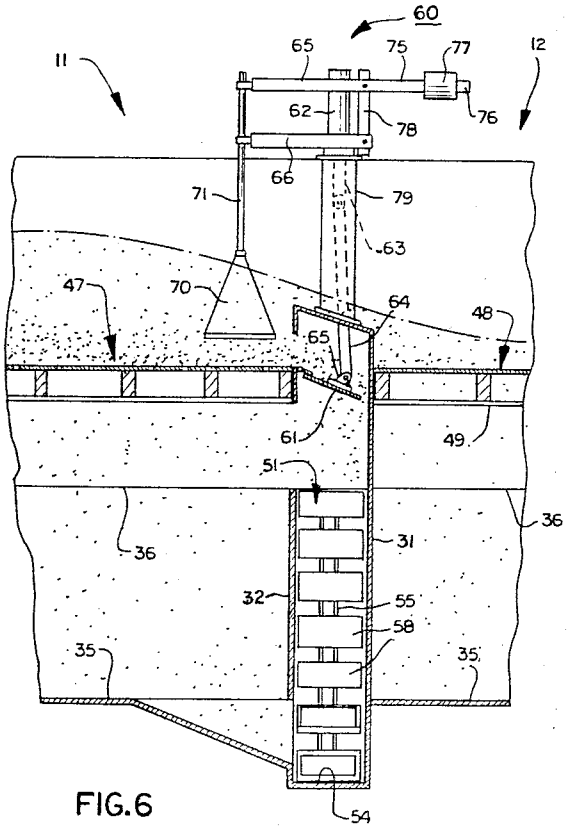
FIG. 6 is a fragmentary sectional view on an enlarged scale taken on the line 6—6 of FIG. 2.

Referring to FIG. 6, refuse that is collected at the bottom of the water tank 30 of the respective cell is released through a hinged refuse gate forming part of the gate assembly and drops down into the refuse bin 51. In the bin, the material is picked up by the elevator and conveyed upwardly and laterally to the refuse dump chute at the side of the respective cell (FIG. 5).

The elevator comprises a roller chain 55 that passes around upper and lower sprockets 56 and 57 and which pivotally supports a plurality of buckets 58. The upper sprocket 57 is driven through a belt drive by a drive motor 59 which is controlled in association with the gate assembly. Located at the bottom of the respective adjacent water tank is a trough portion adapted to guide additional refuse that falls through the screen 48 onto the floor 35 of the cell. Thus, the elevator buckets not only pick up the refuse that drops through the gate but also whatever refuse collects on the bottom of the water tank.

The pumping action of the plunger causes a horizontal flow component (in addition to the vertical component) that tends to convey the material of lower specific gravity laterally across the elevator chamber to the adjacent cell as best illustrated in FIG. 6.

Gate and Gate Control Assembly

In accordance with the invention the rate of collection and discharge of refuse in each cell is carefully controlled to achieve optimum separation while at the same time avoiding the loss of any of the desired lower density material to the refuse bin. The gate system includes hinged rubber plate 61 associated with the respective elevator assembly and an air cylinder 62 with a piston rod 63. The piston rod is connected to the plate by means of a connecting link 64 pivotally connected at its upper end to the piston rod 63 and at its lower end to a bracket 65 located on top of the plate 61.

The operation of the air cylinder 62 is controlled by a float 70 and an associated mechanism. The float 70 is adapted to be submerged in the slurry over the screen 48 of the respective separation chamber. It is suspended by a float rod 71 from a connecting arm 72 of a parallel link mechanism including links 73 and 74. The upper link 73 has a rearward extension 75 with a threaded rod 76 that receives a counterweight 77. The position of the counterweight 77 may be adjusted to change the balance of the float mechanism. The inner ends of the parallel link mechanism are pivotally connected to a bracket 78 supported on a tubular vertical member 79 that forms an enclosure for the rod 64 and which also supports the air cylinder 62.

The parallel links 73 and 74 each carry a switch operating arm 81, 82 respectively. The switch arms are adapted to engage and operate limit switches 83 and 84 which are adapted to actuate a solenoid valve (not shown) that controls the air cylinder 62. Accordingly, the position of the float 70 serves to control through the air cylinder 62 the operation of the gate 61. The limit switches 83 and 84 also control the elevator motor 59.

The float will of course raise and lower in response to the wave action generated by the plunger assembly 40 so that some play or free motion is provided between the upper and lower limit positions where the limit switches are actuated. As more of the heavier material collects at the bottom of the flow channel, the range of movement of the float will be limited in a downward direction and increased in the upward direction so that eventually the upper limit switch will be actuated to release the gate and dump more refuse from the bottom portion of the flow chamber.

On the other hand, when a substantial amount of the heavier refuse material has been dumped through the gate the range of motion of the float will move progressively lower until the lower limit switch is actuated to close the gate and permit more refuse to collect at the bottom of the flow channel of the respective cell.

Plunger Drive

Each of the four plungers 41 of the respective plunger assemblies 40 has its stroke controlled by its respective eccentric 46. The eccentrics in turn are operated by means of a plunger drive assembly 90 that includes a shaft 91 mounted on the frame 20 to extend longitudinally parallel to the flow channel and to be centered over the respective plunger chamber. The shaft is journalled in a series of bearings 92, 93, 94, 95 and 96 spaced along the frame and is connected midway between adjacent bearings to the respective eccentric mechanism 46. The end of the shaft 91 adjacent the cell 11 has a sprocket 97 keyed thereon and driven by a chain 98 which in turn is driven by the output sprocket of the drive motor 99. In a typical embodiment the shaft is adapted to be driven at 60 rpm so that each plunger has a cycle of about 1 second.

The respective strokes of the plungers 41 are not only adapted to decrease progressively from the cell 11 to the cell 14 but are also phased so that they reinforce the oscillatory wave that progresses along the flow channel. In the wave generating mechanism of the present invention, the wave does not progress and recede in a natural sense from the first cell 11 to the discharge chute but rather obtains reinforcement at each cell. The reinforcement, however is not intended to maintain the same wave amplitude but rather is intended to support a controlled decrease in wave amplitude to achieve the "fine tuning" that the invention provides.

In fact, the fine tuning is such that the most downstream cell 14 has a wave action of a relatively small amplitude so that the remaining relatively light refuse particles in the flowing stream can be closely discriminated in order to separate particles (such as pyritic sulphur) that has a specific gravity very close to that of the coal particles to be concentrated at the completion of the process.

Water Distribution and Recovery System

The water distribution and recovery system of the jigging apparatus shown is adapted to supply approximately 1,800 gallons per minute with most of the water, about 1,650 gallons per minute, being supplied to the cells (i.e. about 400 gallons per minute per cell) and the rest being used as a wetting and conveying medium for the washed material. The water system includes the water tank 18 mounted on the chassis and located below the discharge chute. The discharge chute 28 includes a screen 102 for dewatering purposes so that excess water returns to the tank 18.

The water to the individual cells is provided by a manifold system including a main header 105 with separate branch manifolds 106, 107, 108 and 109 for each cell. The rate of flow through the respective manifolds to the individual cells is controlled by valves 111, 112, 113 and 114 for each cell that are adjusted by handles 115, 116, 117 and 118 mounted on extensions so that they may be adjusted from a walkway along the top of the unit.

Operation

In the operation of the unit, the crushed coal is supplied to the receiving chute 27 where it becomes quickly submerged in water in the flow channel to form a slurry. The horizontal water flow carries the slurry into the wave chamber 38 of the first cell 11 wherein the wave action operates on the material supported above the respective screen 48 forming the floor of the channel to cause the heavier material to collect at the bottom adjacent the screen and the lighter material to be suspended near the top of the slurry.

The natural flow progresses along the channel so that the lighter material is carried over the barrier located above the respective gate 61 and the heavier material collects at the bottom adjacent the screen.

When sufficient material has collected in the cell 11 to effect the position of the float 70, the float actuates the upper limit switch which in turn energizes the solenoid valve that controls the air cylinder 62 so that the gate 61 is pivoted downwardly and heavier refuse is dumped into the bin 51 of the elevator 50. At an appropriate time, the elevator motor 59 is actuated so that the buckets 58 carry the collected refuse upwardly and out to a refuse dump at the side of the unit.

The lighter material passes on to the cell 12 where the resulting slurry is effected by a wave action of smaller amplitude so that a finer discrimination between lighter particles and heavier particles can be achieved and additional refuse is collected adjacent the respective screen 48. The action proceeds as before with the respective gate 61 dumping the refuse into the respective elevator bin.

When the resulting slurry arrives at the most downstream cell 14, most of the heavier refuse has been removed and the remaining refuse in the slurry comprises relatively light particles with a specific gravity only slightly greater than that of the coal particles. Because the amplitude of the wave in the cell 14 is relatively small, i.e. about 2 inches as a result of the 2 inch stroke of the respective plunger, a very fine discrimination can be achieved and as a result the lighter refuse particles, generally pyritic sulphur, settle adjacent the screen of the wave chamber and are eventually dumped into the respective elevator bin.

The cleaned coal particles are then carried by the slurry past the most downstream cell 14 and onto the discharge chute 28 which includes a dewatering screen with a very fine sieve so that some of the water is returned to the collection tank 18. The cleaned coal particles are then transported for further processing.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. Apparatus for separating granular material composed of particles of different specific gravity, comprising:

a frame defining a receiving chute and a discharge chute;

at least four water-containing hydraulic separation cells serially supported on said frame and including an upstream cell operatively associated with said receiving chute and a downstream cell operatively associated with said discharge chute, each cell including:

a wave chamber with a horizontal screen located below the water surface and adapted to support submerged granular material in a slurry;

a refuse bin separated from said wave chamber for receiving refuse in the form of particles of relatively high specific gravity;

means for removing refuse from said bin; and plunger means for cyclically raising and lowering the water level in said wave chamber to cause horizontal separation of particles of different specific gravity, the stroke of the plunger means for each cell being of progressively decreasing magnitude from said upstream cell to said downstream cell;

each plunger means being in opposite phase with any adjacent plunger means so that when the water level in one wave chamber is at its highest level, the water level in any adjacent wave chamber is at its lowest level;

said wave chambers of said cells defining a slurry-filled flow channel extending from said receiving chute to said discharge chute;

whereby said plunger means for said cells generate an oscillating wave that progresses along said flow channel and that has at least two full wave cycles produced therin from said upstream cell to said downstream cell, said wave being reinforced by the plunger means for each successive cell and having a controlled decreasing amplitude from the upstream end to the downstream end of said flow channel so that the wave oscillations at the terminal end of the flow channel are sufficiently small to enable a fine discrimination between a lighter material to be conveyed to the discharge chute and a material relatively close in specific gravity to the lighter material, to be separated from the lighter material.

2. Apparatus as defined in claim 1, wherein said means for removing refuse comprises for each of said bins, a bucket elevator adapted to convey refuse from said bin upwardly above the water level and dump it at the side of the apparatus.

3. Apparatus as defined in claim 1 wherein each of said cells has a water containing plunger chamber laterally adjacent to and communicating with the bottom portion of said wave chamber and wherein said plunger means operates in said plunger chamber to cyclically raise and lower the water level in said wave chamber.

4. Apparatus as defined in claim 3, wherein said plunger means comprises a plunger adapted for vertical reciprocation in said plunger chamber and drive means therefor.

5. Apparatus as defined in claim 4, wherein said drive means for said plunger comprises a horizontal shaft located above and extending across the plunger chamber for each of said cells, an eccentric device operatively connected to said shaft and a connecting rod pivotably connected between said plunger and said eccentric device.

6. Apparatus as defined in claim 1, including water supply means for continuously supplying replacement water to each cell individually and for separately adjusting the rate of water supply to each cell.

7. Apparatus as defined in claim 1, including gate means for controlling the rate of transfer of refuse from each wave chamber to the respective refuse bin.

8. Apparatus as defined in claim 7, wherein said gate means is controlled by a fluid cylinder.

9. Apparatus as defined in claim 8, wherein said fluid cylinder is controlled by a float means located in the respective wave chamber and adapted to sense the quantity of refuse supported above the respective screen of said respective wave chamber.

10. Apparatus as defined in claim 1, wherein said apparatus is mounted on a mobile chassis.

* * * * *